United States Patent [19]

Kober

[11] 4,418,486

[45] Dec. 6, 1983

[54] HEATED SMOOTHING ROLL

[75] Inventor: Kasimir Kober, Niles, Ill.

[73] Assignee: Chicago Dryer Company, Chicago, Ill.

[21] Appl. No.: 315,685

[22] Filed: Oct. 27, 1981

[51] Int. Cl.[3] ..... D06F 61/06; D06F 67/02

[52] U.S. Cl. ..... 38/58; 38/44

[58] Field of Search ..... 100/162 B, 93 RP, 157, 100/176; 29/93 S, 116 R, 130; 38/11, 63, 44, 100, 50

[56] References Cited

U.S. PATENT DOCUMENTS

| | | | |
|---|---|---|---|
| 2,678,600 | 5/1954 | Allen | 100/93 S |
| 2,701,518 | 2/1955 | McDonald | 100/93 S |
| 3,331,434 | 7/1967 | Lockhart | 100/93 RP X |
| 3,634,956 | 1/1972 | Behn | 38/44 X |
| 3,939,763 | 2/1976 | Sato | 100/93 S |
| 4,197,663 | 4/1980 | Riedel | 38/11 X |

FOREIGN PATENT DOCUMENTS

| | | | |
|---|---|---|---|
| 55-144310 | 11/1980 | Japan | 29/116 R |

*Primary Examiner*—Werner H. Schroeder
*Assistant Examiner*—Andrew M. Falik
*Attorney, Agent, or Firm*—Neuman, Williams, Anderson & Olson

[57] ABSTRACT

A rotatable cylinder is provided having an interior cylindrical passageway defined in part by the inner surface of the outer periphery of such rotatable cylinder and the outer surface of an inner, centrally positioned cylinder. Headers having liquid passageways therethrough and applied in a liquid-tight manner to the opposed cylinder ends complete a liquid-tight chamber with the cylindrical passageway through which heated liquid may circulate from one cylinder end to the other. A helical blade disposed in the cylindrical liquid passageway comprises an impeller which assists passage of the liquid through the passageway. The blade also assures desired heat transfer from the circulating liquid to the rotatable cylinder inner surface from which the heat is conducted to the cylinder outer surface whereat the heat is utilized.

6 Claims, 6 Drawing Figures

FIG. 1
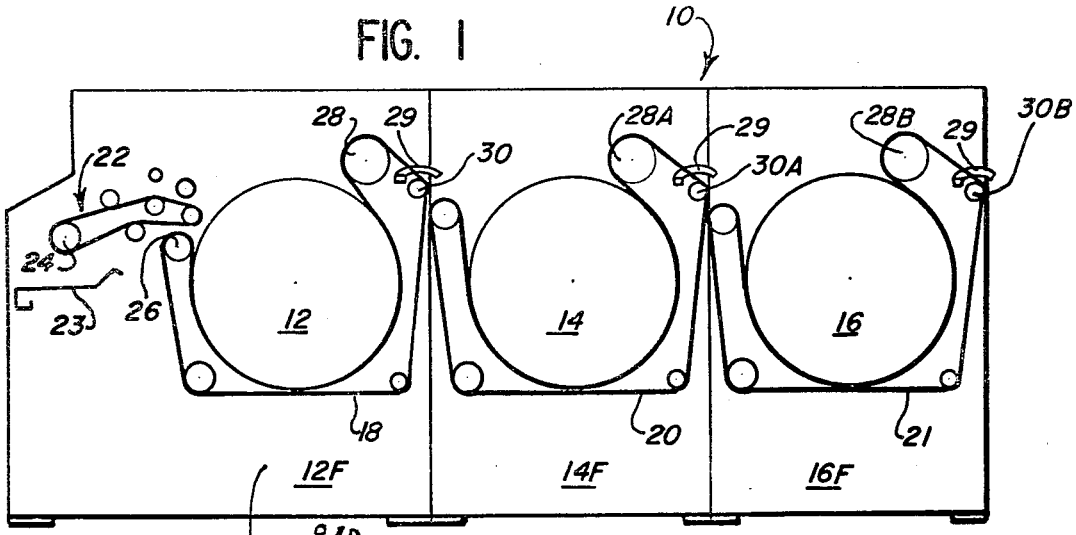
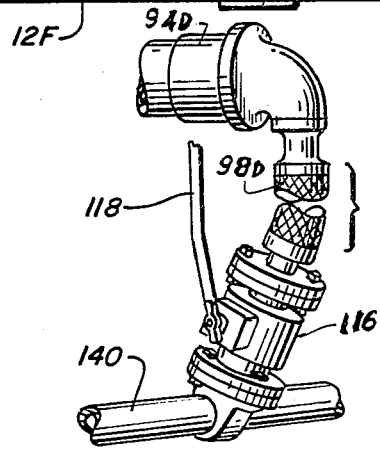
FIG. 2A
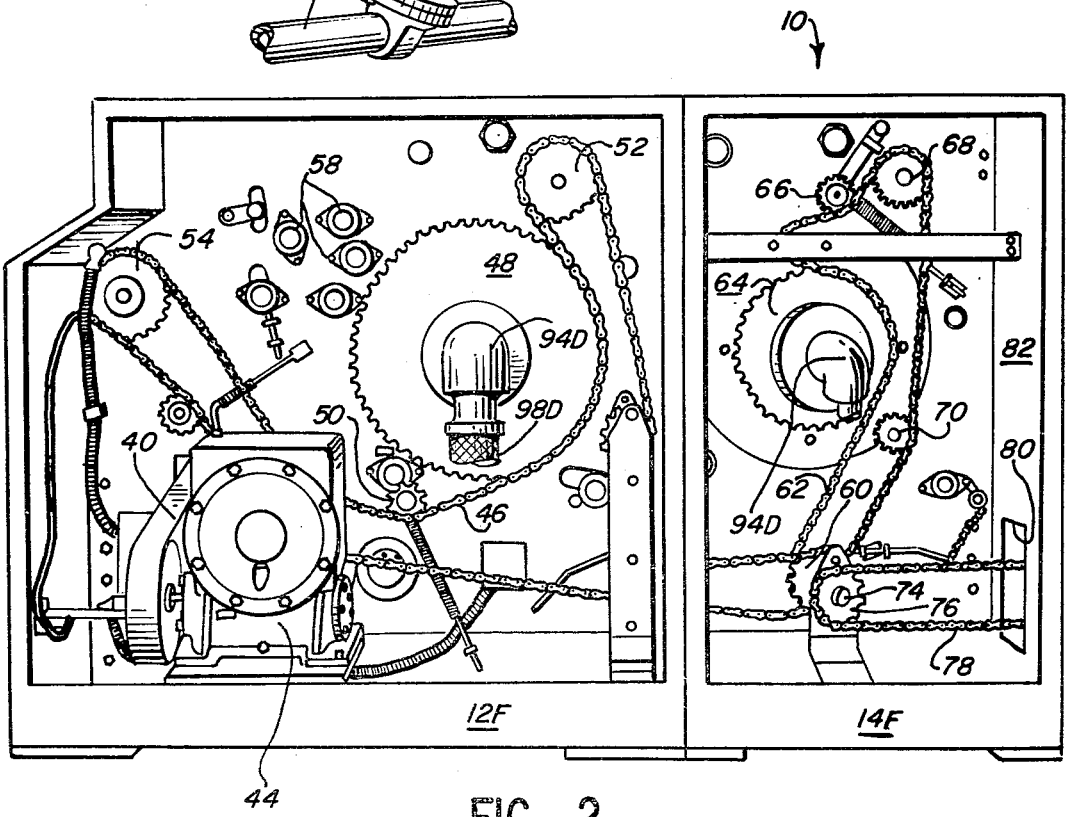
FIG. 2

FIG. 3
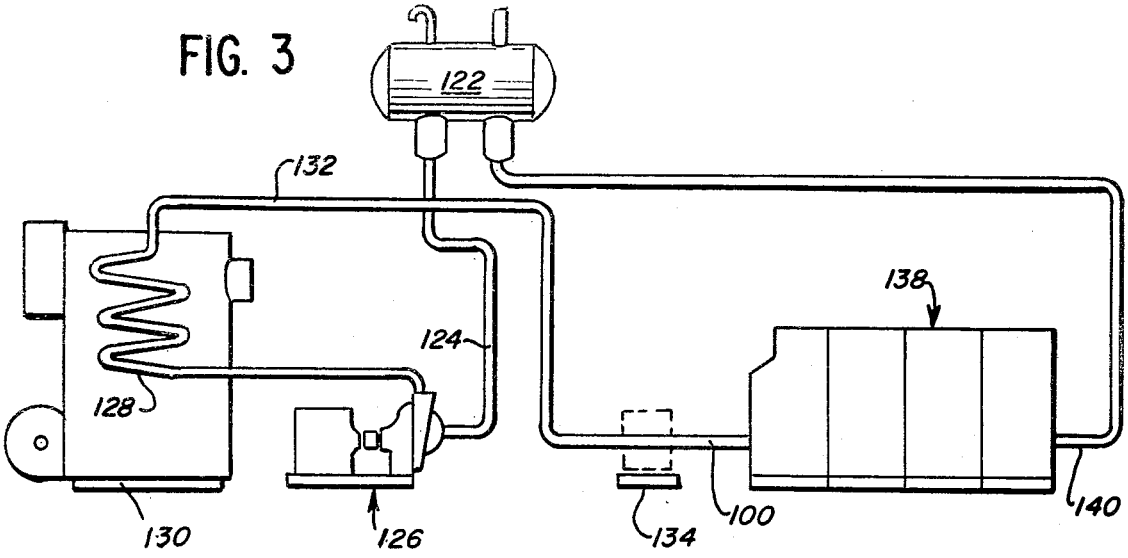
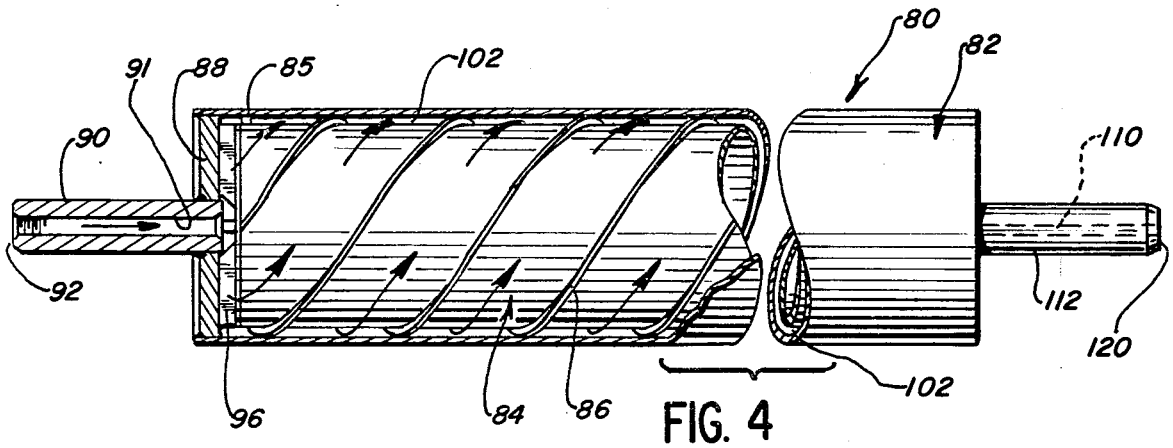
FIG. 4
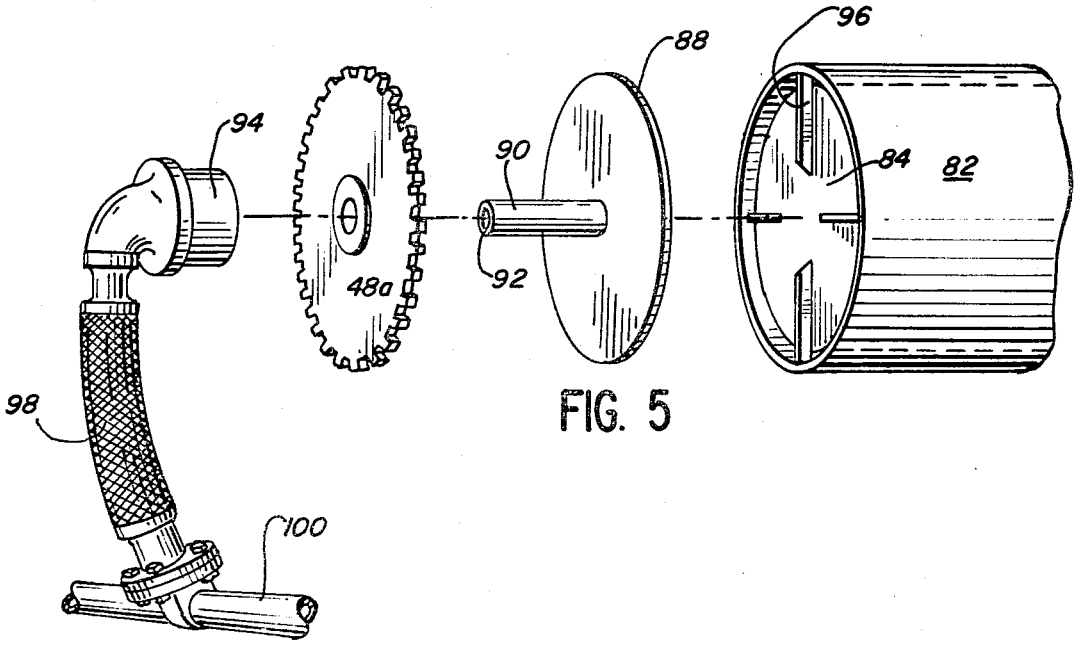
FIG. 5

HEATED SMOOTHING ROLL

This invention relates to a novel rotatable cylinder construction and more particularly pertains to a cylinder construction adapted for heating by a heated liquid passing through an interior passageway thereof. Means are provided in the interior passageway for assisting propelling of the heated liquid through the cylinder and for insuring desired heat transfer between the inner surface of the cylinder and such heated liquid. Heat from the circulating liquid is then conducted through the thickness of the cylinder wall from the cylinder inner surface to the outer cylinder surface whereat the heat is desirably utilized.

The provided cylinder is employed in applications in which a rotatable heated cylinder is employed as in a cylinder ironers employed in commercial laundries. The embodiments hereinafter described in detail pertain to heated cylinders particularly adapted for use in ironers employed for processing laundry.

The use of steam for the heating of rotatable cylinders employed in flatwork ironers is well-known. The use of steam as a heating medium often, if not always, necessitates attendant operations during cylinder use which result in inefficiency of operation and/or added expense. The use of steam normally requires treatment of the water employed for steam generation to eliminate any solids contained therein. The presence of water and steam leads to corrosion problems when employed with apparatus formed of metals subject to rusting.

In flatwork ironers the drying time is inversely proportional to the temperature differential between the heated surface of the ironing cylinder and the temperature of the flatwork being ironed. The cylinder temperature is in turn determined by the pressure of the steam supply. The maximum temperature differential is approximately 350° F. when steam at a boiler pressure of 150 psig is employed. At the more typical boiler pressures of 100 to 125 psig the temperature differentials attained are in the neighborhood of 300° to 350° F. It is thus seen that elevated temperatures employing steam necessitate high boiler pressures with an attendant increase in the danger of explosion.

Also, the use of steam requires the attendance of licensed engineers and equipment such as condensate return systems, sight glasses and check valves.

The prior art has recognized that various disadvantages of steam above set forth and has employed heated liquids which make possible the attaining of elevated temperatures a relatively easy matter. Thermal liquids such as any of a large variety of known oils may easily attain a temperature of 400° F. in the absence of the excessive pressures which would be present with steam-generated temperatures of 400° F. The heat imparted to the circulating thermal liquids entails a cost less than that expended in generating steam of a desired comparable temperature. Such cost advantage is of constantly increasing importance as the cost of fuels and energy generated thereby continue to escalate.

The patentee Etten, in his U.S. Pat. No. 2,004,430, recognized the dangers when employing steam to generate elevated temperatures and disclosed the use of diethylene glycol having a boiling point of approximately 450° F. for heat transfer purposes in a laundry apparatus.

The patentees Gerstenberger et al. in their U.S. Pat. No. 3,879,868 disclose the use of a laundry drying apparatus employing a stationary platen heated by oil circulating in serpentine passageways adjacent the platen undersurface for desired heat transfer purposes. In such apparatus flatwork to be ironed is slidably driven over a platen surface opposed to the serpentine passageways.

American Laundry Machinery Company of Cincinnati, Ohio 45212, manufactures a chest type flatwork ironer under the model designation Hypro II which employs heated thermal liquid for circulating through a stationary chest or cradle over which rotatable rolls move for effecting a desired ironing action.

The prior art, however, nowhere suggests the use of heated thermal liquids for purposes of maintaining a desired elevated temperature at the working surface of a rotating cylinder. Cylinder ironers of the type sold by Chicago Dryer Company of 2200 North Pulaski Rd., Chicago, Ill., under the trademark TITAN are high-capacity ironers employing revolving, polished heated cylinders. Asbestos ribbons move flatwork to be ironed into contact with a major portion of the circumference of each heated roll, allowing a greater peripheral portion of the rotating ironing cylinder to be effectively utilized for ironing purposes than in a comparable chest-type ironer.

In accordance with this invention a novel ironing cylinder construction is provided through which heated thermal liquid may circulate for purposes of efficiently heating the outer working surface of such cylinder.

It is an object of this invention to provide a flatwork ironer employing an ironing cylinder efficiently heated by a thermal liquid circulating through the interior thereof.

It is another object of this invention to provide a rotatable cylinder for a flatwork ironer containing an interior passageway through which thermal liquid may circulate and a cylinder designed to impel liquid from one cylinder end to the other.

It is yet another object of this invention to provide a rotatable cylinder through which a thermal liquid circulates and having blade means disposed within an interior passageway for such liquid. Such blade means assures desired contact of such liquid with the entire interior surface of such cylinder for desired, efficient heat transfer purposes.

The above and other objects of this invention will become more apparent from the following detailed description when read in the light of the drawing and the appended claims.

In one embodiment of the provided invention a rotatable cylinder employed in a flatwork ironer has a major portion of its exterior periphery engaged by asbestos belts adapted to convey damp flatwork to be ironed into contact therewith as the cylinder rotates. Disposed within the ironing cylinder interior is a concentrically arranged, closed cylinder defining a cylindrical passageway through the outer cylinder length defined by the outer surface of the inner cylinder and the inner surface of the outer ironer cylinder. Disposed in the cylindrical passageway is a helical ribbon or blade mounted about the periphery of the inner cylinder. The cylinders are welded or otherwise suitably arranged into an integral unit. A heated thermal liquid is passed through a sealing header at one end of the cylinder assembly for passage through the intra-cylinder passageway. As the cylinder assembly rotates, the spiral blade serves to drive the heated thermal liquid from the entrance end of the cylinder assembly through the liquid passageway to the exit end of the cylinder assembly.

The spiral ribbon also assures good liquid-to-surface contact with the inner surface of the cylinder as will hereinafter be described in greater detail.

For a more complete understanding of this invention reference will now be made to the drawing wherein:

FIG. 1 is a schematic side elevational view of a flatwork ironer employing ironing cylinders made in accordance with the teachings of this invention;

FIG. 2A is a fragmentary perspective view of a valve employed in controlling the flow of thermal liquid exiting a heated cylinder;

FIG. 2 is a side elevational view illustrating driving mechanism employed for purposes of rotating the ironing cylinders such as those illustrated in FIG. 1;

FIG. 3 is a schematic flow diagram illustrating a path of thermal liquid employed in heating flatwork ironing cylinders made in accordance with this invention;

FIG. 4 is an elevational view partly broken away illustrating the double-cylinder construction of a cylinder heated by thermal fluids and made in accordance with the teachings of this invention; and FIG. 5 is a fragmentary exploded view illustrating a feed line and a rotary union employed in feeding thermal liquid into the receiving end of a cylinder made in accordance with the teachings of this invention.

For a more complete understanding of this invention reference will now be made in FIG. 1 wherein a flatwork ironer 10 is illustrated comprising rotatable cylinders 12, 14 and 16 arranged in series. Each cylinder 12, 14 and 16 in conjunction with a separate engaging series of endless asbestos belts 18, 20 and 21 respectively is adapted to iron large, damp flatwork pieces such as sheets which are fed between the series of belts 18 and the periphery of cylinder 12 by means of feed conveyor 22 having belts rotatably movable about large roller 24 and smaller idler rollers. The fed sheets to be processed have been washed and extracted and are fed in the damp condition for removal of remaining moisture disposed therein.

Flatwork such as large sheets or the like upon leaving contact with feed conveyor 22 enters the bite defined by the endless belts 18 and the adjacent periphery of cylinder 12. The conveyed sheet or the like is compressed between roll 26 and the first ironer cylinder 12. The roll 26 insures the application of desired initial pressure between the conveying belts 18 and the outer periphery of the ironing cylinder 12 whereby the sheets or the like may be gripped and driven by the belts over the heated periphery of the first ironing cylinder 12 prior to leaving engagement therewith upon a change in direction of such belt series caused by a guide roller 28. The conveyed sheets will then pass over smaller belt guide roller 30 prior to being engaged by conveyor belts 20 and urged into contact with the heated periphery of ironing cylinder 14 whereafter the conveyed flatwork will leave contact with the periphery thereof upon engaging guide rollers 28A and 30A prior to being conveyed into contact with the heated periphery of the final heated cylinder 16. Upon leaving contact with the cylinder 16, the now dry flatwork will be guided about roller 28B and 30B prior to being discharged onto the feed ribbons of a folding apparatus or onto a discharge shelf. Illustrated exhaust ducts 29 facilitate discharge of steam vapor to the exterior of the building in which the ironer is located.

The aforedescribed ironing cylinders of ironer 10 all rotate counter clockwise and in conjunction with their respective series of continuous asbestos belts moving from left to right, function to convey the flatwork being ironed from the left sheet shelf 23 to the right in the course of passing through the ironer 10 as illustrated in FIG. 1.

The ironer 10 composed of a plurality of heated cylinders 12 through 16 as previously described, is sold under the trademark TITAN by the Chicago Dryer Company of Chicago, Ill. These ironers are particularly adapted for high-volume ironing such as normally occurs in hospitals, hotels, commercial laundries, linen supply plants, etc. The number of ironing cylinders may vary from one to as many as four or more depending upon the desired ironing speed and capacity. For purposes of assisting the ironing action on the fed flatwork, the series of belts 18, 20 and 21 may linearly move faster than the peripheral speed of the surfaces of the cylinders 12 through 16 so as to effect a drawing or stretching action on the flatwork when brought into contact with the cylindrical surfaces. Such action insures the absence of wrinkling and provide a desired, smooth finish to the flatwork articles. Also, the cylinders through appropriate gearing may rotate at increasing speeds whereby passage of the laundry through the ironer proceeds at increased speeds.

Each cylinder is shown mounted in a frame section 12F, 14F and 16F which may be bolted or otherwise secured together. In accordance with the desired ironing action, the cylinders may be in units of 1, 2, 4, or more as above mentioned, in which event the requisite number of supporting frames are bolted together at the frame interfaces, leveled, and anchored in place.

The driving mechanism for effecting a desired rotational movement of the driving cylinders may be as illustrated in FIG. 2. FIG. 2 illustrates the drive chains and auxiliary apparatus employed for purposes of driving two cylinders such as cylinders 12 and 14 of FIG. 1. The prime mover for the illustrated cylinders may comprise a variable speed motor (not illustrated) located between the ironer sidewalls and which may be any of a number of well-known variable speed electrical motors which may run on 60 cycle current and which may vary in voltage depending upon the power necessary for desirably driving the cylinders employed. The motor output shaft drives a drive belt 40 illustrated in FIG. 2 which in turn drives the input shaft of speed reducer 44. The output shaft of the speed reducer in turn drives an output shaft and sprocket which drives a chain 46 engaging the teeth of drive sprocket 48 mounted on the end of cylinder 12 for rotatably driving the same counter clockwise. The drive chain 46 also engages spring-loaded sprocket 50 which imparts desired tension to the chain 46. Chain 46 also engages sprocket 52 and sprocket 54 which may be employed for purposes of driving drive rollers of the provided ironer apparatus such as drive roller 24 of the feed conveyor 22 illustrated in FIG. 1.

FIG. 2 also illustrates a number of adjustably positionable bearings 58 for the various rollers about which the various conveying belts move. Drive chain 46 may also drive a sprocket 60 mounted in frame portion 14F of the ironer 10. As viewed in FIG. 2, drive chain 62 engaging sprocket 60 engages the teeth of drive sprocket 64 rotatably driving the heated ironing cylinder 14, being mounted on the drive end thereof.

Drive chain 62 of cylinder 14 also engages a spring-loaded tensioning sprocket 66 in a manner well-known in the art and also engages and rotatably drives the sprockets 68 and 70 which may be sprockets employed for purposes of driving the asbestos conveying belts employed in conjunction with the ironing cylinders. Mounted on shaft 74 on which sprocket 60 is mounted is a sprocket 76 which drives chain 78 passing through opening 80 in wall 82 of frame 14F in which the rotatable cylinder 14 and its drive sprocket 64 are mounted. Chain 78 is intended to engage an appropriate sprocket to the right in FIG. 2 for purposes of rotatably driving a drive sprocket mounted on the drive end of the rotatable heating cylinder 16 illustrated in FIG. 1.

In accordance with this invention, each of the rotatable ironing cylinders 12, 14 and 16 employed in the flatwork ironer 10 of the type sold by the Chicago Dryer Company under the trademark TITAN, employs for purposes of aiding the interior thereof a heated thermal liquid. As mentioned in the original portion of the specification, the use of steam possesses many disadvantages. The generation of elevated temperatures by steam requires high pressures leading to the increase in an attendant explosion hazard. The use of relatively incompressible heat transfer liquids substantially eliminates the hazard as the liquid heating medium is conveyed at substantially atmospheric pressure.

Use of the thermal liquids provide for a fast warmup due to the smaller volume of fluid which is circulated through the system; from a cold start, temperatures in the 420°–425° F. range can be reached in as few as 15 minutes.

The absence of steam and the water necessary to generate the same eliminates any water treatment necessary when generating steam, eliminates the need for condensate return, steam traps, sight glasses and check valves. The corrosion problems existing when steam is present are eliminated with the heated thermal liquids and in general a smaller, cleaner plant layout is obtainable because of the more efficient heat input provided by the thermal liquid systems.

Cylinder assembly 80 of FIG. 4 illustrates a rotatable heating cylinder adapted to be employed in a heated cylinder flatwork ironer such as ironer 10 and comprises a usual, outer, smooth-surfaced cylinder 82 which may have length of 120 inches, an outer diameter of twenty-four inches, although other rolls or cylinders of differing dimensions may obviously be employed. Within the outer larger cylinder 82 is an inner cylinder 84 of an outer diameter of twenty-two inches and which is concentrically arranged with the outer cylinder and welded or otherwise fixed in relative position with cylinder 82. Spaced end welds as at 85 in FIG. 4 may be employed for effecting the desired concentric spacing between cylinders 82 and 84. Prior to the assembly of the inner cylinder 84 within the outer cylinder 82, a spiral driving blade or ribbon 86 is welded or otherwise suitably affixed in a helical manner to the outer periphery of the inner cylinder 84 in the manner clearly seen in FIG. 4. The outer periphery of the ribbon 86 effects a clearance with the inner peripheral wall of the outer cylinder 82 which is preferably a fraction of an inch such as ⅜ inch. Welded or otherwise secured in fluid sealing engagement with the opposed ends of the outer cylinder 82 are end plates 88 illustrated in perspective in FIG. 5, and apertured for interfitting fluid-tight engagement with a cylindrical tubular member 90 having central passageway 91. Outer end 92 of tube 90 is adapted to engage in fluid-sealing engagement with a rotary union 94 through which a heated thermal liquid passes through the fluid passageway 91 in member 90.

It will be noted from FIG. 5 that cylinder 84 is shorter than cylinder 82 and each end of the cylinder 84 is spaced inwardly from the terminal end of the outer cylinder 82. Thus, when the header plate 88 is welded in place in the manner illustrated in FIG. 4, the outer surface of the plate 88 may be substantially flush with the distal ends of the outer cylinder 82. It will be noted from FIG. 5 that each end of the inner cylinder 84 may have four fluid-directing vanes or ribs 96 welded in place thereon.

It is the purpose of the vanes 96 radially direct the heated thermal fluid passing through the rotary union 94 from flexible sleeve 98 from the fluid inlet line 100 into the interval between the outer periphery of the inner cylinder 84 and the inner periphery of the outer cylinder 82. The interval between the latter surfaces defines a cylindrical passageway 102, see FIG. 4, through which the incoming heated thermal liquid passes about the outer periphery of the inner cylinder 84 until emerging through fluid passageway 110. The latter is disposed in outlet tubular member 112 secured to a header plate similar to plate 88 and disposed at the discharge end of the ironing cylinder 80 illustrated in FIG. 4. A valve member 116 which may be actuated into the open and closed positions by means of an actuating lever arm 118 is interposed exit end 120 of passageway 110 as illustrated in FIG. 2A and a fluid exit line 140. A rotary union 94D and flexible hose 98D are in the series relationship illustrated for providing liquid discharge from the cylinders. The valve enables the rate of liquid passage through the cylinders to be desirably throttled and controlled.

In accordance with this invention it is the function of the spiral vane 86 welded or otherwise suitably affixed to the outer periphery of the inner cylinder 84 to assist in impelling the heated fluid from the inlet passageway 91 of the header 88 to the opposed discharge passageway 110 disposed adjacent the exit end of the passageway 102 of the heated cylinder 80.

FIG. 5 also illustrates a drive sprocket 48A which is fixedly mounted over the cylindrical tubular member 90 prior to engagement of the end 92 thereof by the rotary union 94. Flexing hose 98 is interposed the thermal fluid inlet line 100 and the union 94 for providing thermal liquid passage into the rotatable heated cylinder.

Also, in accordance with this invention the spiral fin or blade 86 facilitates in driving the heated thermal liquid from the entrance end 92 of the header cylinder assembly of FIG. 4 to the exit end 120 of the liquid discharge conduit 112 disposed at the opposed cylinder end. In addition, blade 86 insures desired and intimate contact between the flowing heated thermal fluid and substantially the entire surface of the inner periphery of the outer cylinder 82. In the absence of means such as blade 86 or the like, heated thermal fluid pumped into a concentric cylinder arrangement of the type illustrated in FIG. 4 will effect inefficient heat transfer with the inner periphery of the outer cylinder inasmuch as the flowing liquid has a tendency to "hug" the outer surface of the inner cylinder. As a result of such poor heat transfer to the inner surface of the outer cylinder 82, the heat conduction to the outer working surface of the cylinder 82 will be poor with a resulting inefficiency of heat utilization.

FIG. 3 comprises a schematic flow diagram illustrating a manner whereby a thermal fluid may pass from an expansion tank 122, through a line 124 into a pump 126. The liquid is pumped through a coil 128 of a heating unit 130. The heated fluid is pumped from the heater 130 and passes through a header line 132 from which the fluid may pass to auxiliary pump 134. The use of pump 134 is optional depending upon desired heat input and speed of operation. The heated fluid then enters line 100 also seen in FIG. 5, from which the heated thermal fluid may pass into each rotatable cylinder of each unit of a four-section flatwork ironer 138 as may be of the type sold by the Chicago Dryer Company under the Model designation TITAN IV. As illustrated in FIGS. 4 and 5, the heated thermal fluid passes into the left end of each rotatable cylinder and discharges from the right end through rotatable unions 94D of the cylinders 12 and 14 in the manner illustrated in FIGS. 2 and 2A. FIG. 2 illustrates a rotary union communicating with a flexible conduit 98D fragmentarily shown, the latter conduit communicating with discharge line 140, see FIG. 3, which returns the now partially cooled thermal liquid to the expansion tank 122 for recycling to the pump 126 and heater 130 in the manner previously described. Valves 116 are located between conduits 98D and line 140 as seen in FIG. 2A.

The thermal fluid heater system and the accessory equipment including valves, expansion joints, temperature controls, etc. may be of the type sold by the Fulton Thermal Corporation of Jefferson St. Pulaski, N.Y. 13142 under the name THERMOPAC. The thermal fluid which may be employed in the illustrated system for purposes of circulating through the rotatable ironing cylinders of the type disclosed above may be aromatic oils of the type that are resistant to cracking at high temperatures. A variety of such oils which are commercially available should also be resistant to oxidation at high temperatures. Exemplary of such thermal fluids are those sold under the trade names THERMINOL by Monsanto, and those sold under the trademark MOBIL-THERM by Mobil Oil Company.

It is believed that the advantages obtainable by the use of heated thermal fluids rather than by steam have been made graphically apparent from the above. The thermal fluid may effect a temperature on the ironing surface of the provided ironing cylinders in the 400° F. range while at a circulating pressure only slightly above atmospheric, that is atmospheric pressure plus the pressure necessary to overcome friction encountered in the piping.

The provided cylinders realize the utmost in efficiency of heat utilization, assuring maximum utilization of the heat input and in addition assuring minimum energy input by virtue of the use of the more efficient heated thermal liquid. The heating unit employed in the thermal liquid system may be closely regulated to impart the desired temperature to the liquid inserted into the entrance ends of the provided rotatable cylinders. The use of an auxiliary pump 134 of a type well-known in the art may assist the driving blades 86 employed on cylinder drum 84 for purposes of effecting a desired rate of thermal liquid passage through the cylinder passageway 102. Accordingly, applicant's novel cylinder provides for great flexibility in operation, assuring the optimum in temperature control and heat efficiency of and energy utilization.

The provided cylinder construction above described may be employed wherever rotatable heated cylinders are used as in the textile industry in the course of pattern application to fabrics. Heated rotatable cylinders are also employed where both heat and pressure are desired as in various laminating operations and in the rubber industry. Accordingly, the cylinder construction described is not limited to use in a flatwork ironer.

It is believed that the foregoing has made apparent a number of modifications which may be made in the inventive structure disclosed. This invention, therefore, is to be limited only by the scope of the appended claims.

What is claimed is:

1. An ironing apparatus comprising a first rotatable cylinder adapted to have laundry articles urged into engagement with the periphery thereof for effecting an ironing operation; an inner cylinder rotatable as a unit with said first cylinder and mounted within said first rotatable cylinder with the longitudinal cylinder axes substantially coincident so as to define an inner chamber having open ends and disposed in said first cylinder; said chamber being defined by said inner cylinder outer periphery and said first cylinder inner periphery and providing a passageway through which a heated thermal liquid may pass along the length of said first cylinder; said inner chamber being substantially liquid-tight between the open ends thereof; first liquid conduit means for passing a heated thermal liquid into one end of said inner chamber, and second liquid conduit means for removing heated thermal liquid at the opposite end of said inner chamber; helical blade means disposed in said inner chamber between the open ends thereof for impelling heated thermal liquid between said first conduit means and said second conduit means during the normal rotation of the rotatable cylinders; said inner cylinder being of substantially uniform cross-section and said helical blade means being substantially uniformly arranged along the length of said inner chamber between the open ends thereof.

2. The apparatus of claim 1 in combination with flexible ribbon means for guiding laundry items to be ironed into engagement with a major portion of the outer periphery of said first rotatable cylinder, and a plurality of said ironing apparatuses are arranged in series; laundry items being conveyed between such first rotatable cylinders of said apparatuses arranged in series by means of said flexible ribbon means.

3. The apparatus of claim 1 in combination with heated thermal liquid for circulating through the inner chamber of said rotatable cylinder, and means for maintaining said thermal liquid at a desired temperature in the course of circulating through said cylinder.

4. The apparatus of claim 1 in combination with a heated liquid at a temperature in excess of 400° F. and a pressure slightly in excess of atmospheric, comprising means for heating the periphery of said rotatable cylinder and which liquid is passed through said inner chamber between said first and second liquid conduit means.

5. The apparatus of claim 1 in which said helical blade means comprises a continuous blade having a proximal longitudinal edge mounted on the outer periphery of said inner cylinder and having a distal longitudinal edge spaced from the inner periphery of said first rotatable cylinder.

6. The apparatus of claim 1 in which an end chamber is formed at said one end of said inner chamber of said ironing apparatus, and distribution means are disposed in said end chamber for readily distributing incoming heated thermal liquid into said one end of said inner chamber.

* * * * *